United States Patent [19]

Arribau et al.

[11] Patent Number: 4,460,276

[45] Date of Patent: Jul. 17, 1984

[54] OPEN INLET BLENDER

[75] Inventors: Jorge O. Arribau, Englewood; Russell J. Dorn, Aurora; Michael G. Dubic, Littleton, all of Colo.

[73] Assignee: Geo Condor, Inc., Henderson, Colo.

[21] Appl. No.: 408,075

[22] Filed: Aug. 16, 1982

[51] Int. Cl.[3] ..... B28C 5/13; B28C 5/16; B28C 7/00

[52] U.S. Cl. ..... 366/13; 366/40; 366/65; 366/168; 366/262

[58] Field of Search ..... 366/2, 6, 17, 13, 33–35, 366/38, 65, 159, 169, 142, 145, 172, 40, 178–180, 177, 342, 343, 168, 183, 262–265, 279, 292, 293, 342

[56] References Cited

U.S. PATENT DOCUMENTS

| | | | |
|---|---|---|---|
| 2,900,176 | 8/1959 | Krogel . | |
| 3,207,485 | 9/1965 | Warren . | |
| 3,231,245 | 1/1966 | Harvey . | |
| 3,256,181 | 6/1966 | Zingg et al. . | |
| 3,326,536 | 6/1967 | Zingg et al. . | |
| 3,994,480 | 11/1976 | Fothergill et al. . | |
| 4,239,396 | 12/1980 | Arribau et al. | 366/2 |

FOREIGN PATENT DOCUMENTS

WO81/03143 12/1981 PCT Int'l Appl. .

*Primary Examiner*—Timothy F. Simone
*Attorney, Agent, or Firm*—John E. Reilly

[57] ABSTRACT

A blending apparatus comprises a generally cylindrical casing bounded by top and bottom walls, the top wall having a central solids inlet for introduction of solids by gravity flow into an impeller mounted for rotation in the casing and in coaxial alignment with the solids inlet. The impeller has one or more spaced plates and impeller vanes mounted thereon which extend radially away from a central opening in the upper plate thereof, the central opening being aligned in open communication with the solids inlet and disposed in closely spaced relation to the top wall in such a way to prevent back-flow of materials from the chamber formed in the casing through the upper solids inlet. Tangentially directed fluid inlet and outlet ports are disposed in the casing's cylindrical wall and the inlet port is disposed in outer radially spaced relation to the impeller preferably with the outlet port spaced below the inlet port and impeller for discharging intermixed materials from the chamber. A pump is provided to pump fluids into the fluid inlet port for mixture with the solids passing through the impeller.

16 Claims, 3 Drawing Figures

OPEN INLET BLENDER

This invention relates to a novel and improved method and apparatus for blending liquid and solid materials; and specifically relates to a portable truck-mounted system which will establish a predetermined pressure between a fluid delivery pump and blender so as to create optimum conditions for the high volume, continuous intermixing of liquids and solids as a preliminary to delivery downhole into subsurface oil or gas producing formations.

BACKGROUND AND FIELD OF THE INVENTION

This invention is directed to certain improvements in a blender chamber of the type which is intended for use in oil and gas well fracturing and cementing operations and by means of which liquid and solid constituents may be intermixed and discharged under considerable pressure downhole. Our prior U.S. Pat. No. 4,239,396 granted to the assignee of the present invention sets forth and describes a high capacity blender adapted for mixing under pressure liquid-to-liquid or liquid-to-solid constituents. As disclosed therein, the blending chamber may be installed on a truck which is parked at the well head site and achieves continuous intermixing by axially directing a liquid stream through a region in outer concentric relation to an impeller which, under rotation, will radially direct solids under centrifugal force into the moving stream of liquid after which the intermixed materials will be advanced through a common discharge outlet. In our international application No. WO 81/03143 published Nov. 12, 1981, a modified form of blender apparatus is disclosed for use in conjunction with a pumping unit and a closed loop piping system which will permit discharge of the intermixed materials from the blender through outlet ports extending along either or both sides of a truck or other vehicle. The pumping unit and blender are driven off of the power transmission train of the truck, and the blender permits isolated injection of liquid and solid constituents through separate liquid and solid inlets for continuous high volume intermixing and discharge through selected ports. However, our prior blender systems employed specially designed casings with the impellers vertically spaced beneath the top walls as well as the liquid inlet, and an interior passage or conduit to direct solids into the impeller in isolated relation to the mixing zone.

In the blender apparatus, it is important that the liquid be directed from an external pumping unit into the blender apparatus at a pressure such that it is capable of intermixing with any solid or liquid constituents which are driven outwardly by the blender impeller; and in this relation that the impeller be capable of developing an angular velocity sufficient to prevent a reverse flow of intermixed materials from within the blender through the impeller and the solids inlet. The intermixed materials will then undergo a reduction in pressure in advancing from the mixing zone through the discharge port of the blender apparatus. The foregoing can be effectively accomplished by positioning the impeller in close proximity to the top wall of the blender casing in alignment with the liquid port or inlet and eliminate special seals or seal elements at the interface between the impeller and stationary wall of the casing thereby avoiding air entrapment. Nevertheless, the impeller will prevent reverse flow of liquid or mixed solids and liquids into the solids inlet; also, pressure conditions within the blender are optimized whereby to establish close control over the relative pressure between the blender and liquid pumping unit.

SUMMARY OF THE INVENTION

It is therefore an object of the present invention to provide for a novel and improved method and apparatus for the high volume, flow-through mixing of fluids and solids which is greatly simplified and efficient in operation.

It is another object of the present invention to provide for a novel and improved method and apparatus for intimate mixing of liquid/liquid or liquid/solid materials within a common chamber in such a way as to achieve high capacity mixing and continuous flow of materials for introduction under pressure into the intended site of use, such as for example, in the high capacity mixing and pumping of materials necessary for fracturing downhole subsurface formations in oil and gas operations.

Another object of the present invention is to provide for a novel and improved method and apparatus for continuously intermixing liquid and solid particulate materials in such a way as to maintain balanced pressure conditions throughout the system and specifically in such a way as to insure that the pressure of incoming liquid materials exceeds that of the mixed materials.

A still further object of the present invention is to provide for a novel and improved mounting and arrangement of a solids mixing impeller with respect to a chamber which will permit gravity flow of solid materials directly into the impeller for intermixture with a high pressure liquid introduced into the same chamber while effectively preventing the backflow of liquid or solid materials through or around the impeller into the solids inlet while permitting the escape of any air from the chamber; and further wherein the blending chamber obviates the use of special seals between the solids inlet and impeller and minimizes pitting and wear of those surfaces exposed to the high velocity stream of materials.

It is an additional object of the present invention to provide for a novel and improved method and means for continuously mixing liquid/solid constituents in which the proportions therebetween can be closely controlled and which is capable of maintaining continuous high volume mixing of the materials over a wide range without stalling the blender.

In accordance with the present invention, a novel blending apparatus has been devised in which a generally cylindrical casing is bounded by top and bottom walls, the top wall having a central solids inlet therein for introduction of solids by gravity flow into an impeller which is mounted for rotation in the casing and in coaxial alignment with the solids inlet. In the preferred form, the impeller has upper and lower spaced plates and impeller vanes mounted therebetween which extend radially away from a central opening in the upper plate of the impeller, the central opening in the upper plate being aligned in open communication with the solids inlet and the upper plate disposed in closely spaced relation to the top wall and in such a way as to prevent backflow of materials from the chamber formed within the casing through the upper solids inlet. By virtue of the relation established between the impeller and top wall, it is possible to eliminate the upper plate and to position the impeller vanes in closely spaced relation to the inner surface of the top wall and prevent reverse flow of materials from the chamber through the solids inlet. Tangentially directed fluid inlet and outlet ports are disposed in the cylindrical wall of the casing, the inlet port disposed in outer radially spaced relation to the impeller and the outlet or discharge port spaced below the inlet port and impeller to discharge intermixed materials from the chamber. Pumping means are provided for pumping fluids into the fluid inlet port for mixture with the solids passing through the impeller and directed into the stream of fluid introduced through the fluid inlet port. The impeller is preferably mounted in the upper portion of the chamber so as to form a gradually increasing area within the casing for the passage and movement of the intermixed liquids and solids through the discharge port. The mounting and disposition of the discharge port is such as to discourage collection of solid materials in the bottom of the chamber and to minimize the necessity of constant cleanout of the casing. The top or upper plate of the impeller has its upper surface in closely spaced, facing relation to the undersurface of the top wall and by virtue of its substantially flush mounting directly adjacent to the solids inlet has been found to effectively form a dynamic seal therebetween which will prevent backflow of material between the impeller and top wall into the solids inlet; yet will avoid air entrapment and energy losses due to frictional engagement between the confronting surfaces of the upper plate and top wall.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
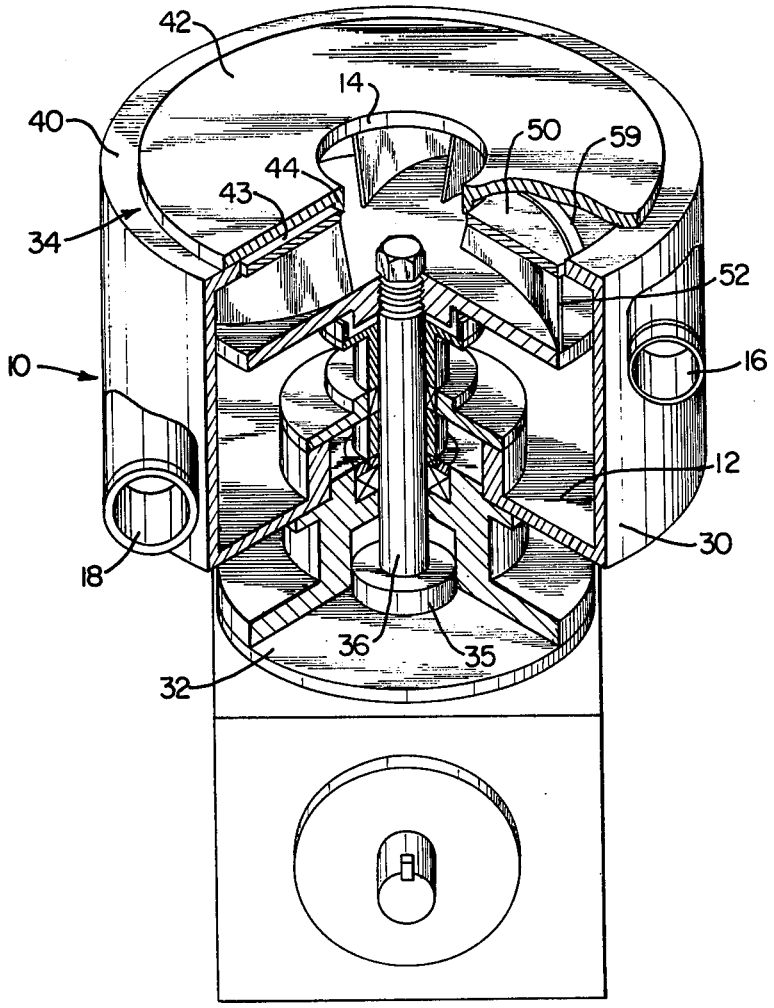
FIG. 1 is a somewhat perspective view partially in section of the blender apparatus of the present invention.
Figure 2:
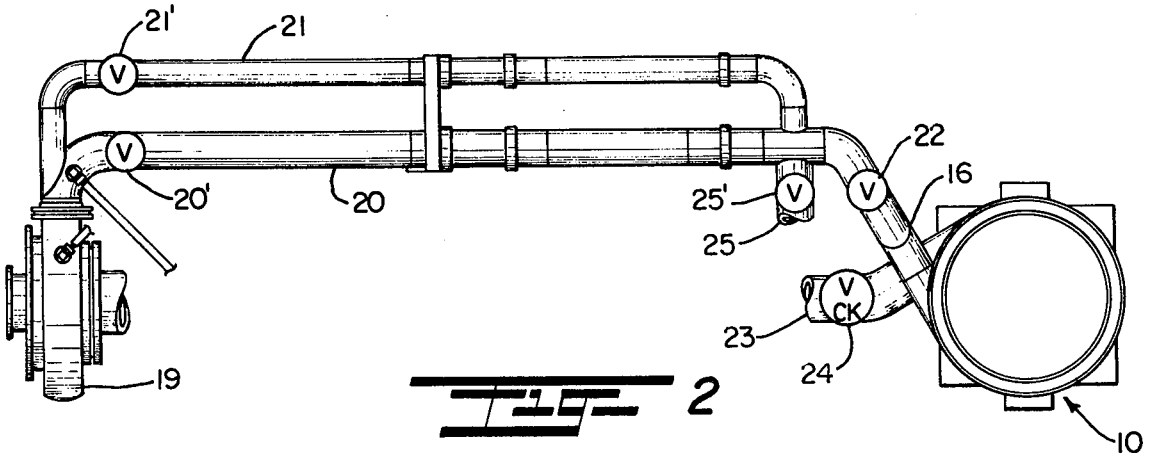
FIG. 2 is a top plan view of the apparatus of FIG. 1 showing interconnection of the preferred form of blender to a fluid delivery pump.
Figure 3:
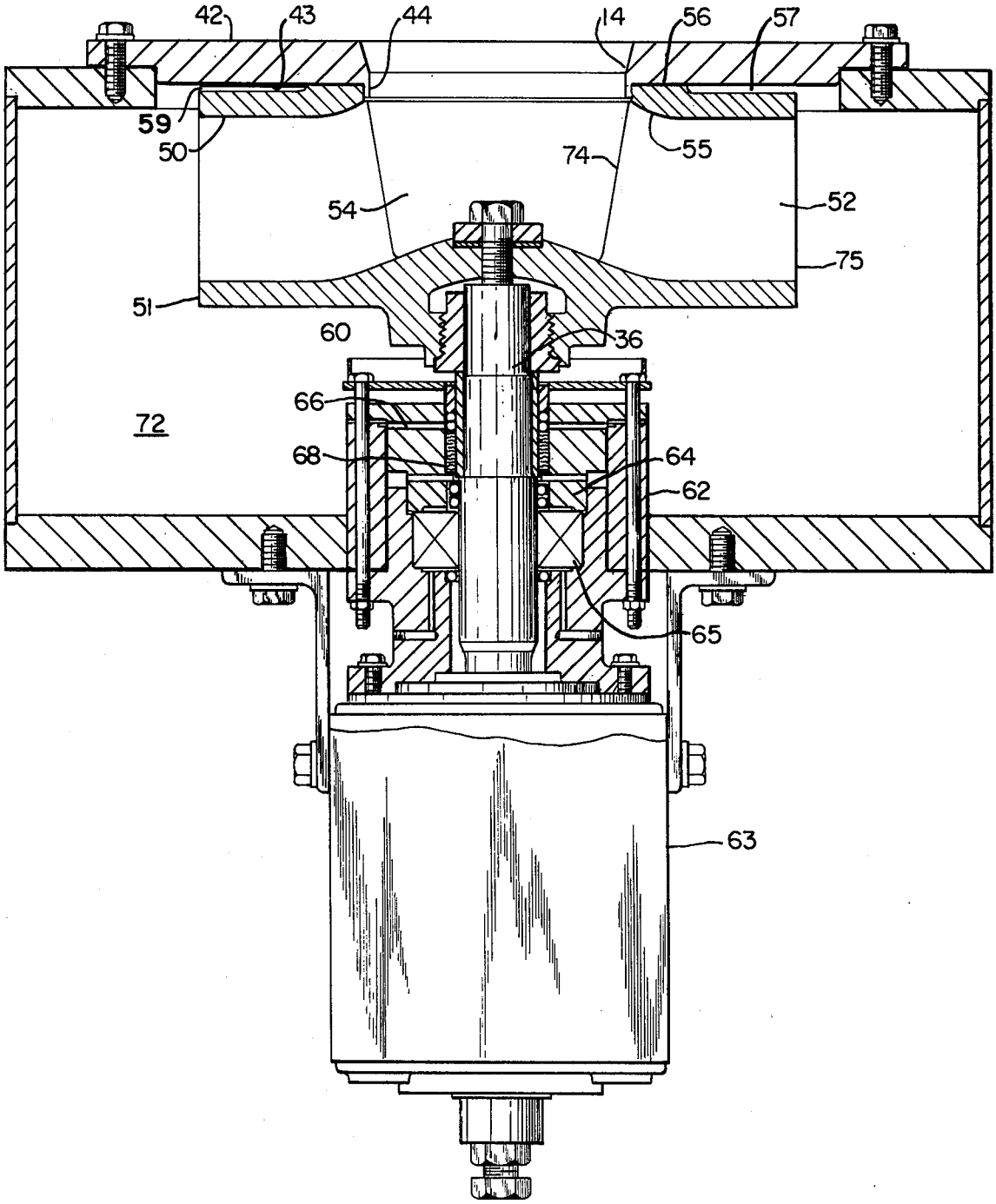
FIG. 3 is an enlarged view, partially in section and in more detail of the preferred form of blender apparatus of the present invention.

The preferred form of blender apparatus in accordance with the present invention is a truck-mounted blender which is installed in the same manner as the blender apparatus of our prior international application published under the Patent Cooperation Treaty No. WO 81/03143, published Nov. 12, 1981 and incorporated by reference herein as to the installation of the blender in a closed loop system. Generally, by reference to FIG. 2 herein, the preferred form of blender apparatus 10 comprises a blending chamber 12 having a solids inlet 14, a liquid inlet port 16 and discharge port 18. The liquid inlet port 16 receives liquid under pressure from a pumping unit 19 either through a low capacity conduit 20 or high capacity conduit 21.

It should be noted that the line 20 from the pumping unit 19 which extends into the liquid inlet 16 has a valve 22 which is preferably of the butterfly type so as to regulate the flow of the liquid introduced into the blending chamber. Preferably, the pump unit 19 is a centrifugal pump which, when driven at the same speed as the impeller 26 in the blender chamber, is given an impeller sized to be of a lesser diameter than that of the impeller 26 so that the angular velocity of the impeller 26 is greater than that of the pumping unit 19. In turn, the discharge conduit 23 leading from the discharge port 18 has a check valve 24 to prevent backflow of material into the blender 10, and a bypass conduit 25 leads from the intersection of the conduits 20 and 21 into the discharge conduit 23 for selective flushing or emergency cleanout of the lines. In order to use the bypass conduit 25, the valves 22 and 24 are closed so as to completely bypass the blending chamber 12. As illustrated and described in more detail in our hereinbefore referred to application No. WO 81/03143, the system is mounted on a truck, such as, a Model K2440 manufactured and sold by Oshkosh Trucks Corp. of Oshkosh, Wis. which is equipped with a transmission leading from the front cab section of the truck along the chassis of the truck bed and having a power takeoff shaft into the rear differential section of the truck. The transmission also serves as a common motive power or drive source both for the blender apparatus 10 and pumping unit 19 through transfer cases which are drivingly connected to the power takeoff shaft; and by driving both the blender 10 and pump 19 from the common power transmission, the pumping unit will not overrun the blender 10 or exceed the pressure limit of the impeller in supplying liquid under pressure into the blender chamber. As earlier described, the angular velocity of the impeller 26 will always exceed that of the pumping unit 19 by virtue of its increased size whereby to prevent the backflow of materials through the impeller and the solids inlet 14.

In the setting described, materials, such as, sand, gel, chemicals, etc. are introduced through the upper open solids inlet 14 and advanced by gravity flow into the high speed rotating impeller 26 mounted for rotation in the upper end of the blending chamber. The solids are discharged under the centrifugal force of the impeller into a swirling stream of liquid which is introduced under pressure by the pump 19 to the liquid inlet 16 radially outwardly of the impeller 26. The mixed materials advance through the blending chamber under pressure through the discharge port 18 and are conducted through the conduit 23 for discharge through one or more parts where they are introduced under pressure into a subsurface formation, for example, for the purpose of fracturing or cementing operations.

Now considering in more detail the preferred form of blender apparatus 10 of the present invention, it is an important feature thereof to achieve high capacity, continuous intermixing of the liquid/solid constituents within the blending chamber for direct flowthrough to the discharge side while closely regulating the relative pressure between the inlet and outlet sides and preventing backflow of materials through the solids inlet without the utilization of any special seal construction between the impeller and the walls of the blending chamber. To this end, the preferred form of blender 10 comprises a straight-walled cylindrical casing 30 having a bottom circular wall 32 and top circular wall 34. The bottom wall as shown is provided with a central opening 35 through which the drive shaft 36 extends into the blending chamber for driving connection to the impeller 26. In turn, the top wall portion 34 contains a central opening which defines the solids inlet 14. Although not shown, any suitable form of hopper or delivery chute may be employed above the solids inlet to guide the free flow of solid material through the central opening defining the solids inlet 14 into the impeller region.

It should be noted that the top wall portion 34 is preferably defined by an annular portion 40 of limited width which extends radially inwardly from the upper edge of the casing 30, and a raised annular wall portion 42 which is positioned on the inner edge of the annular portion 40 so as to be vertically offset above the annular portion 40. The raised portion 42 has a flat undersurface 43 throughout its greater radial extent which terminates in a downwardly projecting lip 44 at the surrounding edge of the solids inlet 14.

The impeller 26 is mounted for rotation in a manner to be described at the upper end of the drive shaft so as to be in close proximity to the open solids inlet 14 and, to this end, is comprised of upper and lower spaced, radially extending circular plates or disks 50 and 51 which are separated by vertically extending, circumferentially spaced vanes 52, the vanes curving outwardly along a generally helical line of curvature from a central recess 54 which is coaxially aligned with and corresponds in diameter to that of the solids inlet 14. Accordingly, the upper disk 50 is of annular configuration to define the inner recess 54 and has an upwardly projecting flange 55 terminating in a flat upper terminal end or seating surface 56 dimensioned to be disposed outwardly of the downwardly projecting lip 44 and in close proximity to the undersurface 43 of the top wall portion 42. Preferably, the terminal end surface 56 is of a width of approximately one-fourth of the radial extent of the disk 50 with a slightly increased clearance space 57 formed along the greater radial distance between the disk 50 and the raised wall portion 42. It has been found that the interrelationship established between the flange 55 and raised wall portion 42 is sufficient to form a dynamic seal which will effectively isolate the blending chamber from the solids inlet and which may be aided by the formation of shallow ribs 59 at spaced circumferential intervals on the upper surface of the disk 50 whereby to resist the entry of the mixed materials from the blender toward the solids inlet 14 along the clearance space 57.

The lower disk 51 has a central hub 60 keyed for rotation at the upper terminal end of the drive shaft 36 with the drive shaft projecting downwardly through a fixed drive sleeve 62 into a transmission drive housing 63 mounted for downward extension from the bottom wall 32 of the casing 30. The drive shaft 36 further is journaled within a bushing 64 supported by a roller bearing 65 within the drive sleeve and the drive sleeve member. It will be noted that an oil line 66 is provided for the purpose of internal lubrication within the drive sleeve with suitable packing and seals 68 disposed in surrounding relation to the drive shaft 36. The mounting and disposition of the drive shaft 36 within the blender chamber 12 is such that the mixing zone formed between the inlet 16 and outer terminal edge of the impeller 26 communicates with an increased chamber area 72 within the chamber opposite to the discharge port 18. In this relation, the discharge port 18 is preferably of increased size relative to that of the inlet and is located at or directly adjacent to the lower end of the blending chamber so as to encourage complete flushing and removal of any of the solid matter introduced into the blending chamber.

The vanes 52 of the impeller preferably correspond to those illustrated and described in our international application No. WO 81/03143 referred to earlier and are comprised of arcuate, generally radial extending blades which are arranged at equally spaced circumferential intervals around the outside of central recessed area 54, each blade having an inner inclined edge 74 which curves outwardly along its length to terminate in an outer vertical edge 75 aligned with the outer extremities of the upper and lower disks 50 and 51. The vanes are made arcuate or bowed to present convex surfaces in the direction of rotation of the impeller so as to encourage outward movement of the material introduced through the solids inlet 14 and, under high speed rotation, to impart a centrifugal force to the material as it is driven through the impeller region into the swirling liquid stream passed into the chamber from the liquid inlet 16. In this manner, the solid materials are thoroughly intermixed with the liquids introduced through the port 16 at the point of discharge of the solids from the impeller. As the materials are intermixed, they will undergo a somewhat helical path of advancement downwardly through the blending chamber for discharge through the port 18. In the arrangement of the preferred form of blending chamber, it has been found that the discharge pressure at the outlet port 18 is lower than the inlet pressure at the liquids inlet 16 and that the pressure established by the pumping unit 19 will establish the maximum pressure in the blending chamber necessary for thorough intermixing of the liquid and solid materials preliminary to discharge through the port 18. In other words, the pressure of the liquids introduced by the pumping unit 19 will be the maximum pressure in the system and a limited drop in pressure is experienced as the materials are intermixed and advanced through the discharge port 18.

A number of advantages are seen to accrue from the construction and arrangement of the impeller within the casing, most notable of which are avoidance of air entrapment at the point of introduction of the solids into the impeller region while preventing the backflow of materials through the solids inlet. Specifically, elimination of any seals at the interface between the upper wall of the impeller and lower wall of the casing permits air to escape back through the solids inlet; yet the interrelationship between the impeller and top wall portion as described is sufficient to prevent backflow of liquid or mixed materials from the mixing region through the impeller or along the interface between the impeller and the casing. This avoids any possible explosion when volatile materials are being mixed in the blender and permits greatly simplified construction both of the casing and impeller itself; also, pitting or wear of the inner chamber surfaces which are exposed to the mixed materials is greatly minimized.

In use, various combinations of materials may be introduced through the upper inlet 14 and tangential inlet port 16 in carrying out high capacity, continuous blending operations. The blender apparatus 10 also will permit recirculation of selected proportions of the mixture discharged through the outlet 18 by reintroducing same after discharge through one of the suction ports on the truck for return through the inlet port 16, as set forth and described in our hereinbefore referred to international application. Depending upon the characteristics and volume of the material to be directed for mixing into the blender chamber 12, either the high capacity line 20 or the low capacity line 21 may be utilized in pumping the liquid from the discharge side of the pumping unit into the inlet port 16. Thus, if the high capacity line 20 is to be utilized, a control valve 20' in the high capacity line 20 is opened and control valve 21' in the low capacity line 21 is closed. Conversely, if the low capacity line 21 is to be placed in operation, the valve 21' is opened and value 20' is closed. Additionally, a control valve 25' in the bypass line 25 leading from the intersection of the lines 20 and 21 will normally remain closed during blending operations. However, when it is desired to flush out the lines to which the blender is connected, the valve 25' is opened and the valves 22 and 24 in the inlet and discharge lines are closed so that the liquid pumped by the pumping unit 19 will bypass the blender and be directed under pressure through the discharge line leading from the blender for distribution through the balance of the piping and distribution system.

In the typical blending operation for use in fracturing of subsurface formations in oil and gas wells, water is introduced into the liquid inlet port 16 and sand together with other chemicals conventionally used in fracturing operations are introduced by gravity flow into the solids inlet 14. Introduction of the material into the solids inlet may be carried out with the use of any suitable type of conveyor or delivery system as described in our hereinbefore referred to U.S. Pat. No. 4,239,396. If an explosive or inflammable mixture is to be blended, it is important that the solids inlet be left open so that any air contained or drawn into the interior of the blending chamber 12 is free to pass upwardly through the solids inlet. Stated another way, the introduction of solid materials into the inlet 14 should be at atmospheric pressure and should be in open communication with the interior of the chamber so as to permit air or other gases to freely escape from the chamber and avoid any possibility of ignition or explosion. Again, this is aided to a great extent by disposition of the impeller directly beneath the open inlet and the top wall of the casing with a slight clearance space being left along the interference therebetween to permit the escape of air or gas. In this relation, it has been found that the upper plate 50 can be eliminated and the impeller vanes supported solely by the lower plate 51 such that the upper edges of the vanes are in close proximity to the inner surface of the raised wall portion 42. Nevertheless, by maintaining the angular velocity of the impeller 26 at a higher rate than that of the unit, the impeller will prevent reverse flow of materials from the blender chamber through the solids inlet. Thus, the pumping unit 19 can never exceed the pressure limit of the blending chamber and more specifically that of the impeller 26 in pumping liquid under pressure thereto. It will be evident that the force of delivery of solids as well as liquid constituents into the blending chamber may be regulated not only by the sizing of the impellers in the blender and pumping units but by their relative speeds. Moreover, it has been found that the discharge port 18 should be sized to be greater than that of the inlet port to accommodate the increase volume of intermixed material introduced into the liquid pumped into the blending chamber.

It is therefore to be understood that various modifications and changes may be made in the method and apparatus of the present invention without departing from the spirit and scope thereof as defined by the appended claims.

We claim:

1. An impeller-type blender apparatus adapted for intermixing materials comprising:

a generally cylindrical casing bounded by a bottom wall and a top wall, said top wall provided with a central opening therein defining a top inlet;

an impeller mounted for rotation in said casing in coaxial alignment with said central opening, said impeller having upper and lower support plates and impeller vanes extending radially of and mounted between said support plates with a central opening aligned in open communication with and directly beneath said top inlet, said impeller having dynamic sealing means defined by a raised surface portion on said upper plate disposed in substantially flush abutting relation to said top wall to prevent backflow of intermixed materials in said casing through said top inlet without entrapping air in said blender;

inlet and outlet ports disposed in said casing radially outwardly of said impeller; and pumping means for pumping fluids into said inlet port for intermixing with materials introduced through said top inlet into the center of said impeller and directed radially outwardly by said impeller vanes.

2. An apparatus according to claim 1, further characterized in that solids are introduced into said top inlet at atmospheric pressure.

3. An apparatus according to claim 1, said outlet port being of a size greater than said inlet port.

4. An apparatus according to claim 1, said impeller dimensioned to occupy the upper portion of said casing only with a chamber of increased area formed between said inlet port and said outlet port within said casing for the discharge of intermixed solids and fluids therefrom.

5. An apparatus according to claim 1, said top wall having a recessed inner surface portion in surrounding relation to said top inlet, said recessed inner surface portion being relatively flat and disposed in contiguous relation to said upper plate.

6. An apparatus according to claim 5, said upper plate having an outer circumference less than that of said recessed inner surface, said impeller vanes extending radially between said support plate and said upper plate.

7. An apparatus according to claim 6, said raised surface disposed in flush abutting relation to said recessed inner surface, said raised surface disposed in surrounding relation to the central opening in said impeller directly beneath said central opening in said top wall.

8. An apparatus according to claim 7, said casing being in the form of a straight cylinder having flat top and bottom walls, said top wall having a downwardly projecting ledge projecting into said central opening of said impeller, and said raised surface on said upper plate disposed radially outwardly of said ledge.

9. An impeller-type blender apparatus for intermixing solid and liquid materials comprising:

a generally cylindrical casing bounded by a bottom wall and an upper relatively flat top wall, said top wall provided with a central opening therein defining a solids inlet;

an impeller mounted for rotation in said casing in coaxial alignment with said solids inlet, said impeller having upper and lower spaced disks and impeller vanes extending radially between said upper and lower disks with a central opening in said upper disk aligned in open communication with said solids inlet in said top wall, and dynamic sealing means between said upper disk and said top wall to prevent backflow of mixed materials in said casing through said solids inlet while enabling air to be released through said solids inlet;

a tangentially directed liquid inlet port disposed in said casing in horizontal alignment radially outwardly of said impeller, and a tangentially directed outlet port disposed in said casing below said impeller; and pumping means for pumping liquids into said inlet port for intermixing with solids introduced through said solids inlet into the center of said impeller and directed outwardly by said impeller vanes, said pumping means operative to pump liquid into said casing at a pressure capable of intermixing with the solids directed radially outwardly by said impeller vanes, and means for rotating said impeller vanes at an angular velocity sufficient to prevent the flow of intermixed materials from said casing through said solids inlet.

10. An apparatus according to claim 9, further characterized in that said solids are introduced by gravity flow into said solids inlet.

11. An apparatus according to claim 10, said fluids outlet port being of a size greater than the fluids inlet port and located adjacent to said bottom wall.

12. An apparatus according to claim 9, said impeller dimensioned to occupy the upper portion of said casing only with a chamber of increased area formed between said inlet port and said outlet port within said casing for the discharge of intermixed solids and liquids therefrom.

13. An apparatus according to claim 11, said top wall having a recessed inner surface portion in surrounding relation to said central opening, said recessed inner surface portion being relatively flat and disposed contiguous to said upper disk of said impeller.

14. An apparatus according to claim 13, said upper disk disposed in parallel relation to said recessed inner surface and having a plurality of upper spaced helical ribs thereon.

15. An apparatus according to claim 14, said dynamic sealing means defined by a raised inner concentric surface on said upper disk in substantially flush abutting relation to said recessed inner surface, said raised surface disposed in surrounding relation to the central opening in said impeller.

16. An apparatus according to claim 15, said casing being in the form of a straight cylinder having flat top and bottom walls, and said inlet and outlet ports being tangentially directed in opposite directions to one another at upper and lower ends of said casing, respectively.

* * * * *

UNITED STATES PATENT AND TRADEMARK OFFICE

CERTIFICATE OF CORRECTION

PATENT NO. : 4,460,276

DATED : July 17, 1984

INVENTOR(S) : Arribau, Jorge O. et al

It is certified that error appears in the above—identified patent and that said Letters Patent is hereby corrected as shown below:

Column 3, line 34, cancel "foregoing" and substitute -- following --.

Column 7, line 41, cancel "interference" and substitute -- interface --.

Signed and Sealed this

*Nineteenth* Day of *March 1985*

[SEAL]

*Attest:*

DONALD J. QUIGG

*Attesting Officer* *Acting Commissioner of Patents and Trademarks*